United States Patent [19]

Diel

[11] 4,418,619

[45] Dec. 6, 1983

[54] IMPRINTING APPARATUS WITH RELOCATABLE PRINTING DEVICE

[75] Inventor: Paul A. Diel, Fairfield, Conn.

[73] Assignee: Pitney Bowes Inc., Stamford, Conn.

[21] Appl. No.: 338,699

[22] Filed: Jan. 11, 1982

[51] Int. Cl.[3] ..... B41F 3/04

[52] U.S. Cl. ..... 101/269; 101/45; 101/407 BP

[58] Field of Search ..... 101/269, 45, 56, 407 BD

[56] References Cited

U.S. PATENT DOCUMENTS

| | | | |
|---|---|---|---|
| 3,421,436 | 1/1969 | Patterson et al. | 101/269 X |
| 3,610,148 | 10/1971 | Penaluna | 101/269 |
| 3,707,911 | 1/1972 | Patterson | 101/269 |
| 3,800,700 | 4/1974 | McInnis et al. | 101/269 |
| 3,818,828 | 6/1974 | Nakada et al. | 101/269 |
| 3,890,899 | 6/1975 | Brugge et al. | 101/269 |

*Primary Examiner*—Edward M. Coven

*Attorney, Agent, or Firm*—Donald P. Walker; Melvin J. Scolnick; Albert W. Scribner

[57] ABSTRACT

Imprinting apparatus is provided which includes framework, a printing device, and a roller platen movably attached to the framework for movement from a print ready position to a home position. The roller platen is disposed for urging a pressure sensitive medium into imprinting engagement with the printing device in the course of such movement. In addition, the apparatus includes structure for supporting the printing device. The structure includes an anvil constructed and arranged for carrying the printing device in either of two different locations relative to the print-ready position of the roller platen.

12 Claims, 9 Drawing Figures

Fig. 3.
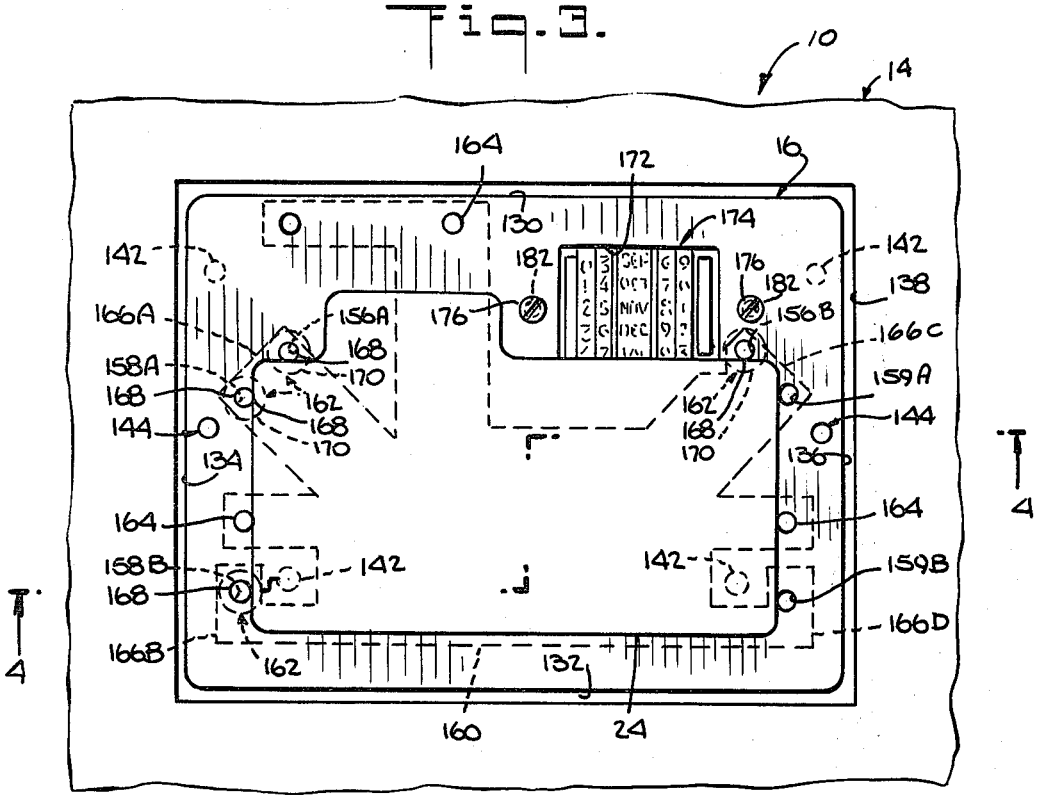
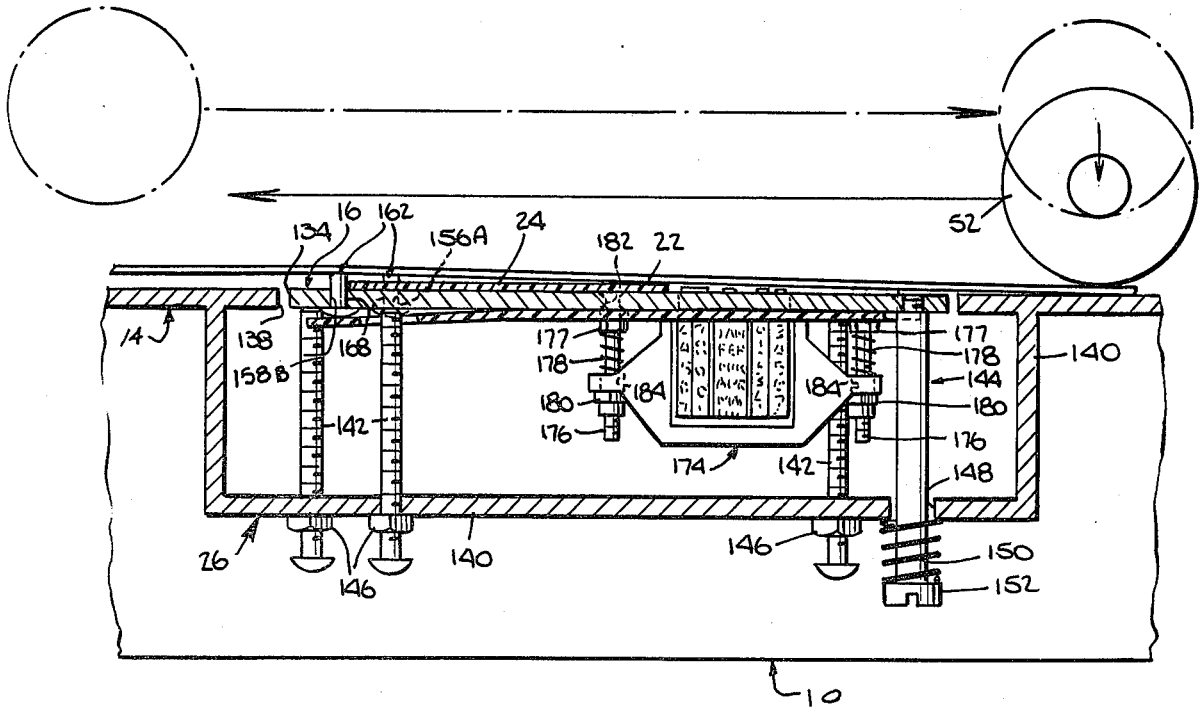
Fig. 4.

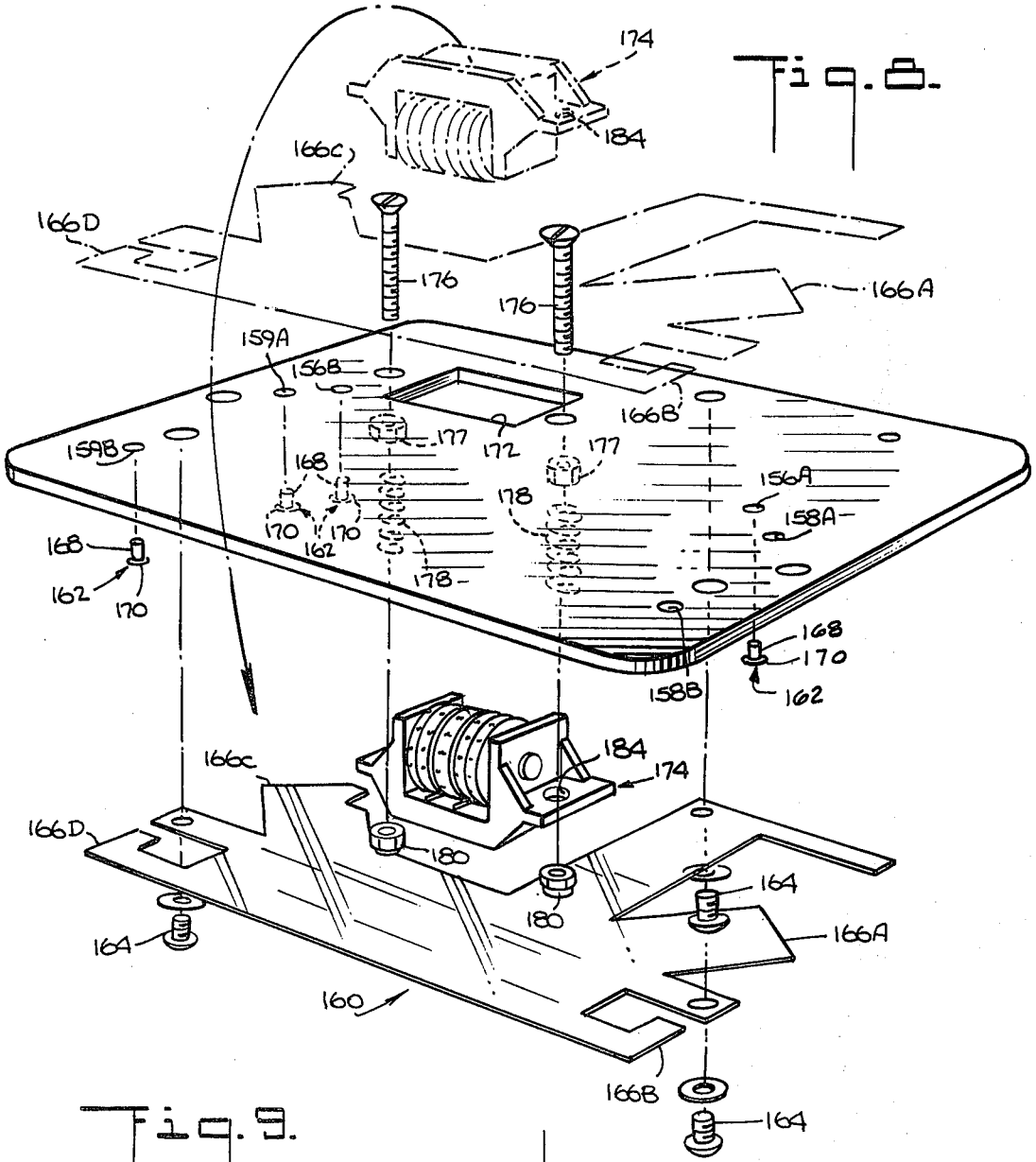
Fig. 8.
Fig. 9.
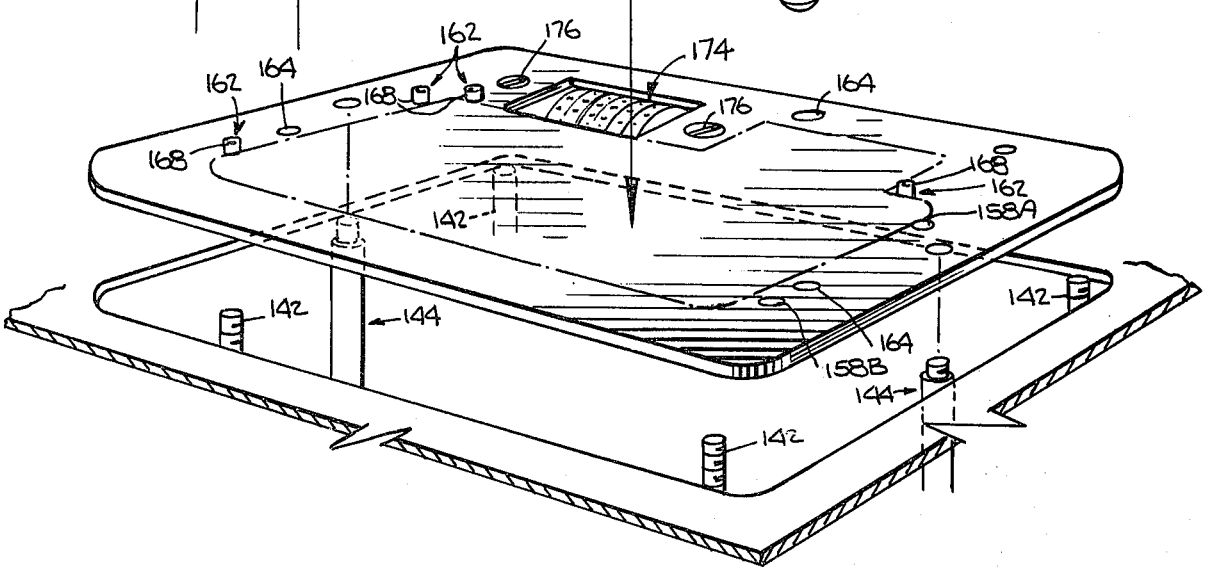

IMPRINTING APPARATUS WITH RELOCATABLE PRINTING DEVICE

BACKGROUND OF THE INVENTION

Imprinters of type shown in U.S. Pat. No. 3,272,120, issued Sept. 13, 1966 to D. W. Johnson, No. 3,340,800 issued Sept. 12, 1967 to J. H. Gruver et al., No. 3,763,777, issued Oct. 9, 1973 to A. C. Brown and No. 4,281,596 issued Aug. 4, 1981 to J. H. Bowen, generally include a roller platen which overhangs an anvil upon which an embossed data bearing card is removably placed, and means for urging the roller platen into rolling engagement with a pressure sensitive record medium, disposed in overlying relationship with respect to the embossed card, with sufficient force for imprinting the pressure sensitive medium with the data borne by the card. In addition, such imprinters typically includes a selectively adjustable printing device which is fixedly attached to the anvil for imprinting the pressure sensitive medium with variable data, such as a date, serial number, code or other information borne by the printing device.

Assuming imprintation takes place in the course of movement of the roller platen in a given direction, imprintation of the variable data occurs either before or after imprintation of data from the embossed card, or concurrently therewith, depending upon the location of the selectively adjustable printing device relative to the location of the card on the anvil. In practice, the location of printing device relative to the card is fixed at the time of manufacture. And, in order to offer their customers a choice of location of the fixed printing device manufacturers are required to stock at least two models of the same imprinter, for example, one model which locates the printing device above the right hand corner of a typically dimensioned embossed card placed on the anvil, and another model which locates the printing device above the left hand corner. This results in escalated manufacturing costs and costs attributable to the need to inventory different models of the same imprinter and different spare parts for servicing purposes. And, more often than not, such costs are ultimately borne by the consumer. Accordingly;

An object of the invention is to provide improved imprinting apparatus;

Another object is to provide an imprinter which is constructed and arranged for locating a printing device in either of two locations relative to an embossed card which may be mounted thereon; and Another object is to provide an imprinter including a roller platen, anvil and printing device, wherein the anvil is constructed and arranged for orienting either of its opposed major surfaces upwardly beneath the roller platen and for carrying the printing device in a first position when one of its major surfaces is so upwardly oriented and in a second position when the other of its major surfaces is so upwardly oriented.

SUMMARY OF THE INVENTION

Imprinting apparatus is provided which includes framework, a printing device, and a roller platen movably attached to the framework. The roller platen is movable from a print ready position to a home position, and is disposed for urging a pressure sensitive medium into imprinting engagement with the printing device in the course of such movement. In addition, the apparatus includes means for supporting the printing device. The supporting means includes an anvil which is constructed and arranged for carrying the printing device in either of two different locations relative to the print-ready position of the roller platen.

BRIEF DESCRIPTION OF THE DRAWINGS

As shown in the drawings, wherein like reference numerals designate like or corresponding parts throughout the several views:

FIG. 3 is an enlarged, fragmentary, top view of the imprinting apparatus of FIG. 1, showing details of the anvil according to the invention;

FIG. 4 is a sectional elevation taken substantially along the line 4—4 of FIG. 3, showing framework of the imprinting apparatus and structure for removably attaching the anvil to the framework;

FIG. 8 is a view of FIG. 7, showing the printing device and leaf spring being positioned for attachment to the other side of the platen; and FIG. 9 is a view of FIG. 8 showing the platen being remounted in the housing of the imprinting apparatus.

DESCRIPTION OF THE PREFERRED EMBODIMENT

Figure 1:
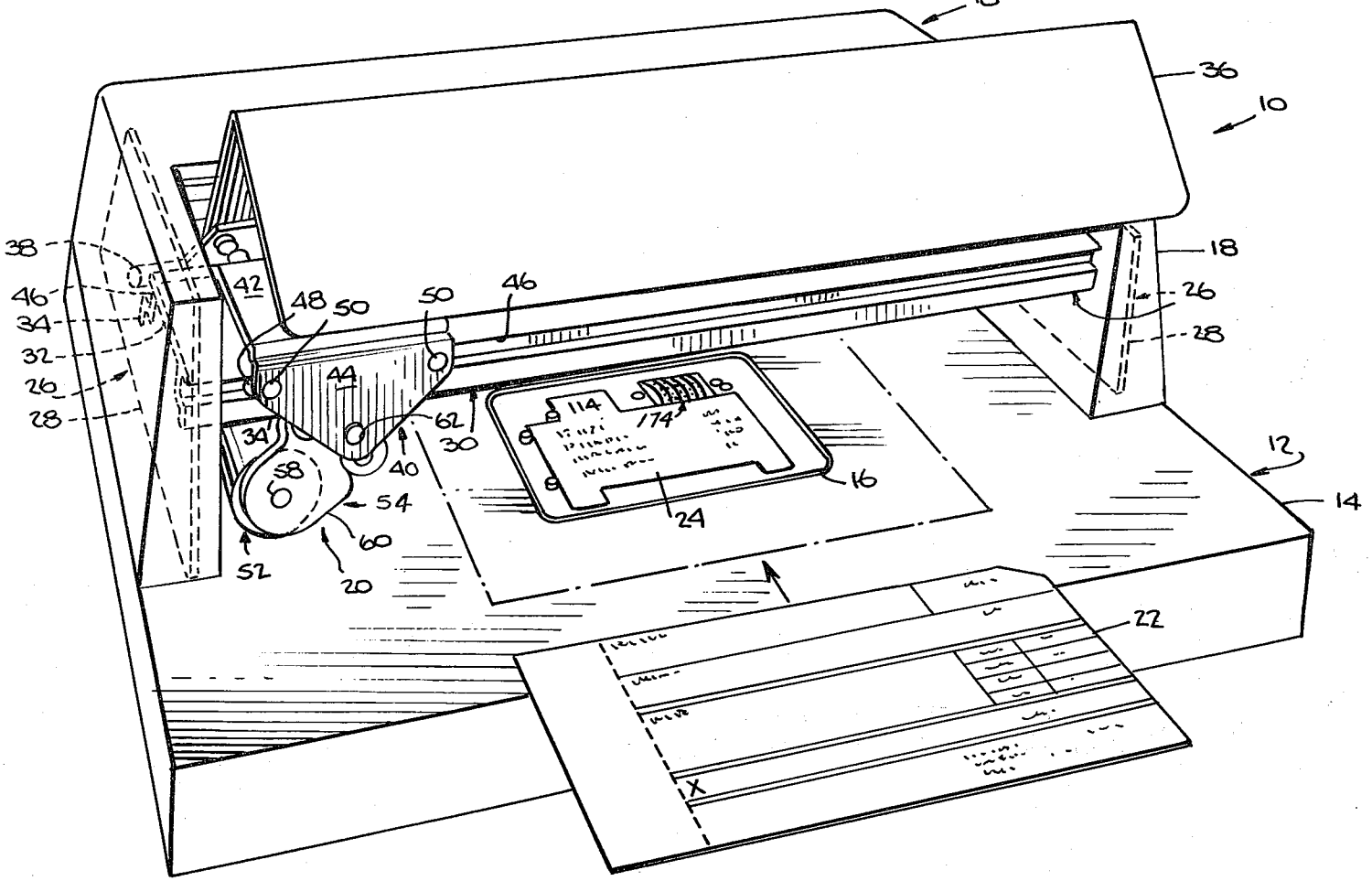
FIG. 1 is a perspective view, partially schematic, of imprinting apparatus of the type which may be modified in accordance with the present invention.

A conventional imprinter 10 (FIG. 1), of the type which may be modified in accordance with the invention, generally comprises a housing 12 which includes a base 14 for housing an anvil 16, and a cover 18 for housing conventional structure 20 for applying pressure to a pressure sensitive record medium 22 disposed in overlying relationship with respect to a data embossed card 24 which is removably placed on the anvil 16.

The imprinter 10 includes conventional framework 26 (FIG. 1) for supporting the various components of the imprinter 10, including the pressure applying structure 20. The framework 26 includes a pair of oppositely-spaced, upright, plates 28 which are suitably fixedly attached to the base 14. In addition, the framework 26 includes an elongate structural member 30 having an upper wall 32 and having oppositely-spaced, longitudinally-extending, depending, side walls 34.

The cover 18 (FIG. 1) includes an elongate door 36, which is L-shaped in transverse cross-section. The door 36 is conventionally pivotably attached to the respective framework plates 28, as by means of a pivot pin 38 which both fixedly attached to one of the legs of the door 36 and is suitably rotatably attached to each of the opposed plates 28. The door 36 is normally held open as shown in FIG. 1 by means of a tension spring 39 (FIG. 2) which is suitably attached to the door 36 and to the framework 26 for holding the door 36 against a conventional stop 39A until the door 36 is manually closed against the tension of the spring 39.

The pressure applying structure 20 (FIG. 1) includes a yoke 40 having an upper wall 42 and having oppositely spaced, depending, side walls 44. The yoke 40 is conventionally attached to the structural member 30 for reciprocable movement longitudinally of the length of the member 30. To that end, each of the member's side walls 34 is provided with a longitudinally extending channel 46, and each of the yoke's side walls 44 is provided with a plurality of rollers 48. The rollers 48 are conventionally rotatably attached to the respective side walls 44, as by means of pivot pins 50, and are dimensioned for disposition within the opposed channels 46 and in rolling engagement with the member's side walls 34. The pressure applying structure 20 also includes a roller platen 52, and includes a bracket 54 for carrying the platen 52. The roller platen 52 is an elongate, cylindrically-shaped, member which is made of a resilient material such as rubber. The bracket 54 includes a pair of oppositely-disposed, depending, legs 60 to which the platen 52 is rotatably attached by means of a roller shaft 58. The bracket 54 is conventionally pivotably attached to the yoke's side walls 44, as by means of a pivot pin 62, whereby the bracket 54 and thus the roller platen 52 is carried by the yoke 40 as the yoke 40 reciprocably moves lengthwise of the structural member 30.

The pressure applying structure 20 additionally includes an elongate rod 64 (FIG. 2), a bearing roller 66 and bracket pivoting stop structure 68. The rod 64 is conventionally rotatably attached to bracket 54, as by means of a swivel 70 which extends from the bracket 54 and into engagement with the rod 64. To restrain movement of the rod 64 to substantially horizontal movement, there is provided a suitable pair of spaced apart stops 72. The stops 72 threadably extend through the yoke 40 and into close proximity with respect to the rod 64 on opposite sides of the swivel 70. The bearing roller 66 is conventionally rotatably attached to the bracket 54 beneath the side wall 34, as by means of a pivot pin 74. The bracket pivoting stop structure 68 includes a member which has a head portion 76 and a stem portion 78, and includes a compression spring 80. The stem portion 78 is mounted in sliding engagement with an opening 82 formed in the bracket 54. And the head portion 76 is disposed in engagement with the interior surface of the one of the yoke side walls 44. The compressed spring 80 is mounted in surrounding relationship with respect to the stem portion 78 between the bracket 54 and head portion 76, for urging the head portion 76 into bearing engagement with the associated yoke side wall 44 beneath the adjacent side wall 34.

As shown in FIG. 3, the pressure applying structure 20 has a home position, which is established when the rod 64 is disposed in engagement with the left-hand framework plate 28 and the head portion 76 of the bracket pivoting stop structure 68 is disposed in engagement with the lower end edge of the side wall 34. In the home position, the roller platen 52 is raised for disposition above the level of the anvil 16. Accordingly, when the pressure applying structure 20 is moved to the right from the home position and into overhanging relationship with respect to the anvil 16, the roller platen 52 is disposed out of imprinting relationship with the embossed card 24 (FIG. 1) on the anvil 16. The pressure applying structure 20 (FIG. 2) also has a print-ready position which is established when the rod 64 is disposed in engagement with the right-hand framework plate 28 and the bearing roller 66 is disposed in engagement with the lower end edge of the side wall 34. In the print-ready position, the roller platen 52 is lowered for disposition at or just below the level of the anvil 16. Accordingly, when the pressure applying structure 20 is moved to the left from the print-ready position and into overhanging relationship with respect to the anvil 16 the roller platen 52 is disposed in imprinting relationship with respect to the embossed card 24 (FIG. 1) on the anvil 16.

For the purpose of the following discussion, an imprinting cycle is intended to mean one complete cycle of movement of the pressure applying structure 20 (FIG. 2), i.e., from the home position to the print-ready position and back to the home position.

For moving the pressure applying structure 20 (FIG. 2), the imprinter 10 includes a bracket 86, bracket driving structure 88, timing structure 90 and a source of supply of motive power 92. The bracket 86, which has formed therein a vertically extending channel 94, is conventionally fixedly attached to the yoke 40. The driving structure 88 preferably includes an endless sprocket chain 96 which is conventionally looped about an idler sprocket gear 98 and a driven sprocket gear 100. The gears 98 and 100 are each conventionally rotatably attached to the framework 26, as by means of a shaft 102. In addition, the driving structure 90 includes a roller 104, which is rotatably attached to the chain 96 by means of a pin 106 and is disposed within the channel 94 and in rolling engagement with the bracket 86. Further, the driving structure 88 includes a conventional trip member 108, such as a rod, which is fixedly attached to the chain 96 for movement therewith. The timing structure 90 includes a latch member 110 which is conventionally pivotally attached to the framework 26, as by means of a pivot pin 112. The latch member 110 has an upwardly-extending, upper leg, portion 114 and a pair of oppositely laterally-extending, lower leg, portions 116. One of the leg portions 116 extends into the path of travel of the chain's trip member 108 and the other leg portion 116 is normally held against a conventional stop 118 by means of a tension spring 120 which has one end connected to the latch member 110 and the other end suitably attached to the framework 26. In addition, the timing structure 90 includes an arm 122, which is suitably constructed and arranged to extend from the door 36 and into engagement with latch member's upper leg portion 114. The timing structure 90 also includes a conventional, normally open, switch 124, such as a microswitch having an actuating arm 125 which is disposed in interposing relationship with respect to the door's arm 122 and an actuator 126. With this arrangement when the actuating arm 125 is raised into engagement with the switch actuator 126, the switch 124 is electrically closed. The source of supply of motive power 92 includes a conventional A.C. motor 127 which is suitably mechanically connected to the drive gear 100, for rotating the gear 100 when the motor 127 is energized, and is conventionally adapted for electrical connection to a local source of supply of A.C. power 128 via the switch 124, for energizing the motor 127 when the switch 124 is electrically closed and deenergizing the motor 127 when the switch 134 is opened.

Figure 2:
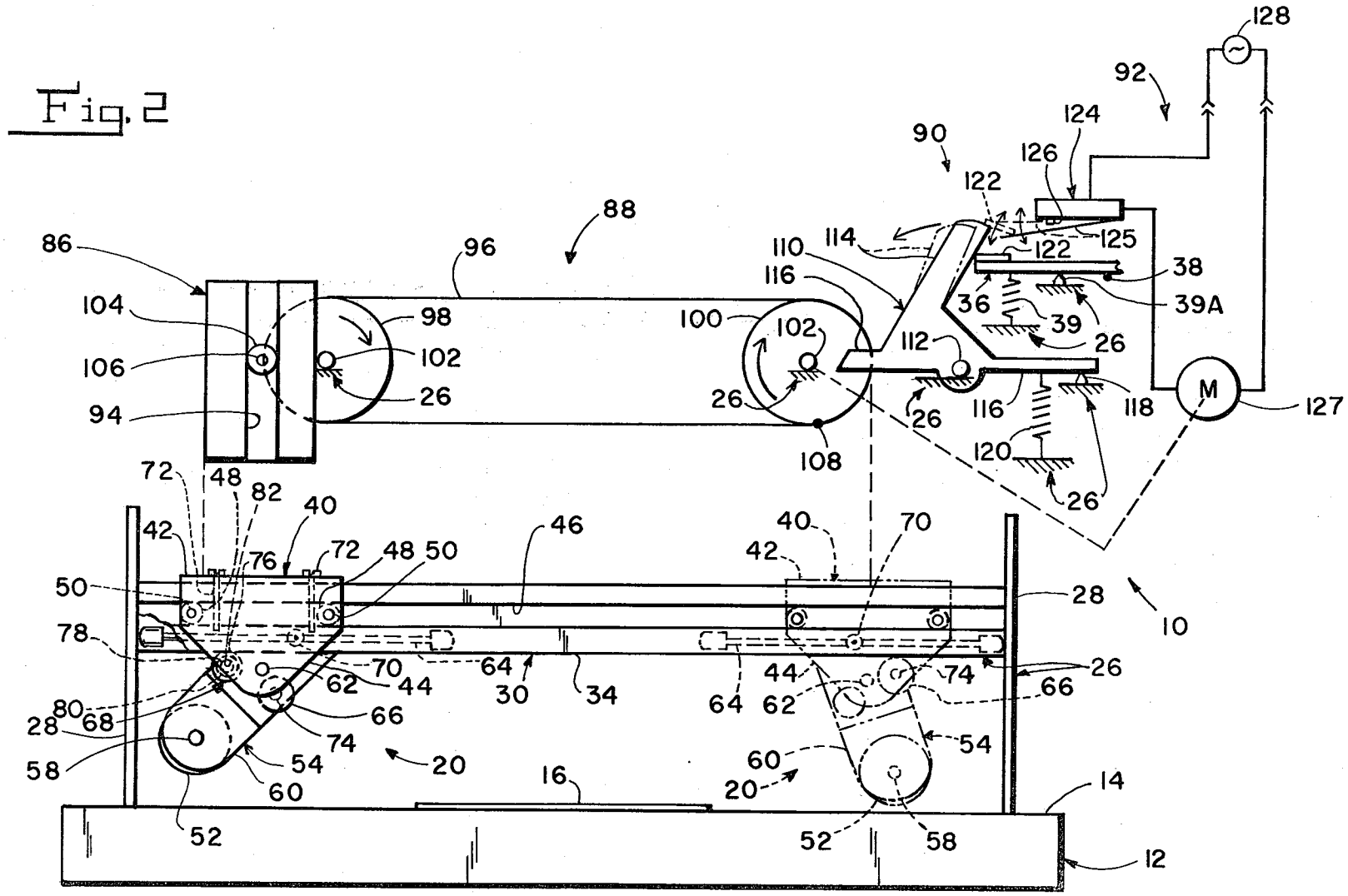
FIG. 2 is a fragmentary, schematic, view of the various operating components of the imprinting apparatus of FIG. 1.

Assuming the door 36 is in its open position as shown in FIG. 2, the door 36 is held in place against the stop 39A, due to the force exerted on the door 36 by the spring 39. Accordingly, the switch arm 125 is disposed out of engagement with actuator 126, with the result that the switch 124 is open, the motor 127 is deenergized, the sprocket gear 100 is stationary and the roller platen 52 is located in its home position. In addition, the latch member 110 is held stationary against the stop 118 due to the force exerted on the latch member 110 by the spring 120.

For commencing an imprinter cycle the door 36 (FIG. 2) is closed against the force exerted by the spring 39. As the door is closed, it is pivoted clockwise on the shaft 38, thereby raising the door's arm 122. The rising arm 122 cams the latch member 110 counter-clockwise on the shaft 112, against the force of the spring 120, and rises the switch's actuating arm 125. When the door's arm 122 is raised sufficiently high, the switch arm 125 engages the switch actuator 126. Whereupon the switch 124 is electrically closed for energization of the motor 127, and the door's arm 122 clears the latch member's upper leg 144 with the result that the latch member 110 is rotated clockwise by the spring 120 for disposing the upper leg 114 beneath the door's arm 122. When so disposed, the latch member's upper leg 114 holds the door's arm 122 upwardly against the force of the spring 39, thereby holding the door 36 closed. In addition, the door's arm 122 holds the switch arm 125 in engagement with the switch actuator 126, thereby maintaining energization of the motor 127. As the motor 127 rotates the drive gear 100, the chain 96 carries the roller 104 in the path of travel of the chain 96 thereby moving the bracket 86, and thus the attached yoke 40, to the right. Since the roller platen 52 is carried by the yoke 40, the platen 52 is moved from its home position toward the print-ready position. When the rod 64 strikes the right-hand plate 28, the rod 64 is held stationary. However, the yoke 40 is thereafter further driven toward the right-hand plate 28, causing the bracket 54 to pivot counter-clockwise about the pin 62 until the bearing roller 66 is urged into rolling engagement with the bracket side wall 34. At this juncture the roller platen 52 is lowered for imprinting purposes and the direction of travel of the yoke 40 is reversed. Continued movement of the chain 96 carries the bracket 86, and thus the yoke 40 and roller platen 52, to the left, over the anvil 16, where the roller platen 52 is disposed in imprinting relationship with respect to both a printing device 174 (FIG. 1) carried by the anvil 16 and the embossed card 24 on the anvil 16, and towards the home position. As the chain 96 (FIG. 2) completes slightly less than one complete revolution, the trip arm 108 engages the latch member's lower leg 116, and rotates the latch member 110 counter-clockwise against the force of the spring 120 until the latch member's upper leg 114 is moved out from beneath the door's arm 122. Whereupon the spring 39 contracts and lowers the door's arm 122, thereby opening the door 36. Concurrently, the arm 122 releases the switch actuating arm 125 from engagement with the switch actuator 126 for opening the switch 124, thereby deenergizing the motor 127. However, before the motor 127 is deenergized the rod 64 strikes the left hand plate 28, and, as the yoke 40 is carried further toward the left, the bracket 54 is pivoted clockwise about the pin 62. When the bracket 54 is sufficiently pivoted, the head portion 76 is urged into engagement with the bracket side wall 34, and the roller platen 52 is raised out of imprinting relationship with respect to the printing device 174 and card 24, to its home position, in timed relationship with deenergization of the motor 127.

As shown in FIG. 3, the anvil 16 is an elongate, rectangularly-shaped, plate which has upper and lower, parallel-shaped, longitudinally extending edges, respectively designated 130 and 132. In addition, the anvil 16 has left and right, parallel-spaced, transversly-extending, side edges, respectively designated 134 and 136. For mounting the anvil 16 in the housing's base 14, the base 14 includes a rectangularly-shaped opening 138 through which the anvil 16 protrudes, and the framework 6 (FIG. 4) includes a generally U-shaped bracket 140 which depends from the base 14. In addition, the imprinter 10 is provided with a plurality of any level adjustment screws 142 and a plurality of anvil locating screws 144 (FIG. 3). Each of the anvil level adjustment screws 142 (FIG. 4) threadably extends through the bracket 140, into abutment with the underside of the anvil 16, and is conventionally held in place by means of a lock nut 146. Further, each of the anvil locating screws 144 threadably extends into the anvil 16 through an aperture 148 formed in the bracket 140. For holding the anvil 16 in abutment with the respective adjusting screws 142, a spring 150 is mounted around each of the locating screws 144 with its upper end disposed in engagement with the underside of the bracket 140 and has its lower end disposed in engagement with the head 152 of the associated locating screw 144. With this arrangement, the anvil 16 may be raised against the forces exerted by the respective springs 150, by threadably rotating the adjustment screws 142 in the direction tending to raise the anvil 16 within the base opening 138. And the anvil 16 may be lowered by the forces exerted by the respective springs 150, by rotating the adjustment screws 142 in the direction tending to lower the screws 142 away from the underside of the anvil 16.

According to the invention, for locating a data embossed card 24 (FIG. 3) on the anvil 16, the anvil 16 has a pair of openings 156A and 156B, which are spaced apart from each other and equidistantly spaced from the upper edge 130 of the anvil 16. In addition, the anvil 16 had formed therein two additional pairs of openings, 158A and 158B and 159A and 159B. The openings 158A and 158B are spaced apart from each other and equidistantly spaced from the anvil's left side edge 134. And the openings 159A and 159B are spaced apart from each other and equidistantly spaced from the anvil's right side edge 136. Further, the imprinter 10 includes a leaf spring 160 and a plurality of pins 162. The spring 160 is conventionally removably fixedly attached to the anvil 16, as by means of a plurality of screws 164. The leaf spring 160 is made of a flexible plastic material and includes a plurality of leaves, respectively designated 166 A–D. When the spring 160 is attached to the anvil 16, the spring leaf 166A is disposed in overlying relationship with respect to the anvil's openings 156A and 158A, the spring leaf 166B is disposed in overlying relationship with respect to the anvil's opening 158B, the spring leaf 166C is disposed in overlying relationship with the anvil's openings 156B and 159A, and the spring leaf 166D is disposed in overlying relationship with respect to the anvil's opening 159B. Each of the pins 162 includes a shank portion 168 and a head portion 170. The shank portions 168 are respectively dimensioned for slidable insertion into any one of the anvil's openings 156A, 156B, 158A, 158B, 159A or 159B, and the respective head portions 170 are dimensioned for seating the pins 162 against a given major surface of the anvil 16. Since the length of each of the shank portions 168 is greater than the thickness of the anvil 16, the shank portions 168 of the seated pins 162 protrude beyond the anvil surface which is opposite to the aforesaid given surface. For example, as shown in FIGS. 3 and 4, a pin 16 is located in each of the anvil's openings 156A, 156B, 158A and 158B from the underside of the anivl 16. And the inserted pins 162 are held in place by spring leaves 166A, 166B and 166C. Accordingly, a data embossed card 24 may be properly located on the anvil 16 by concurrently placing the card's upper edge in engagement with pin shank portions 168 which protrude through the anvil's openings 156A and 156B, and placing the card's left side edge in engagement with the pin shank portions 168 which protrude through the anvil's openings 158A and 158B. And, since pins 162 are not inserted through the anvil's openings 159A and 159B, the card 24 may be dimensioned such that it overlaps the openings 159A and 159B. As shown in FIG. 4, the pin shank portions 168 protrude through the anvil 16 a greater distance than the thickness of the embossed data bearing card 24, with the result that the left hand portion of the pressure sensitive record medium 22 is seated on the upwardly protruding ends of the pins 162 rather than being seated on the upper surface of the card 24. When the roller platen 52 is moved across the anvil 16, from right to left, the platen 52 is lowered for engagement with the embossed card 24, as hereinbefore discussed. As a result, when the platen 52 rolls across the pressure sensitive medium 22 the pins 162 are urged downwardly, against the forces exerted on the pins 162 by the leaf spring 160, thereby permitting the platen 52 to urge the pressure sensitive medium 22 into imprinting engagement with the embossed card 24.

According to the invention, the anvil 16 (FIG. 3) additionally has formed therein a rectangularly-shaped aperture 172 which, as shown in FIG. 3, is located in the upper right hand quadrant of the anvil 16. And the imprinter 10 includes a conventionally constructed, selectively adjustable, printing device 174 for imprinting variable data, such as a date, serial number, code or other information on the pressure sensitive record medium 22 (FIG. 4). The printing device 174 is conventionally removably and adjustably attached to the anvil 16, as by means of a pair of screws 176, lock nuts 177, springs 178 and adjusting nuts 180. When so attached, the printing device 174 (FIG. 3) is supported by the anvil 16 and protrudes through the aperture 172, above the upper surface of the anvil 16 and thus in imprinting relationship with respect to the roller platen 52 (FIG. 4) when the latter moves from the print-ready position to the home position. As so located, the printing device 174 is disposed at substantially the same level as that of the upper surface of an embossed card 24 which has been placed on the anvil 16. The screws 176 each extend downwardly from the upper surface of the anvil 16, through an opening 182 formed in the anvil 16, and are held in place by the lock nuts 177 (FIG. 4). Beneath the lock nuts 177, the screws 176 each extend through an aperture 184 formed in the printing device 174 and into threaded engagement with one of the adjusting nuts 180. For holding the printing device 174 in engagement with the adjusting nuts 180 the springs 178 are mounted around the screws 176, on a one for one basis, with their upper ends disposed in engagement with the associated lock nuts 177 and their lower ends disposed in engagement with the printing device 174. To adjust the distance the printing device 174 protrudes through the anvil's opening 172, the adjusting nuts 180 are rotated either in the direction tending to thread them upwardly on the screws 176, thereby compressing the springs 178 and raising the printing device 174, or in the direction tending to thread them downwardly on the screws 176 thereby allowing the springs 178 to expand for lowering the printing device 174.

The anvil 16 hereinbefore discussed is constructed and arranged for facing either of its opposed major surfaces upwardly and for carrying the printing device 174 in a first position, such as in the upper right hand quadrant of the anvil 16 (FIG. 5), when one of the platen's major surfaces is faced upwardly toward the roller platen 52, and in a second position, such as in the upper left hand quadrant of the anvil 16 (FIG. 9), when the other of its major surfaces is so upwardly faced.

Figure 5:
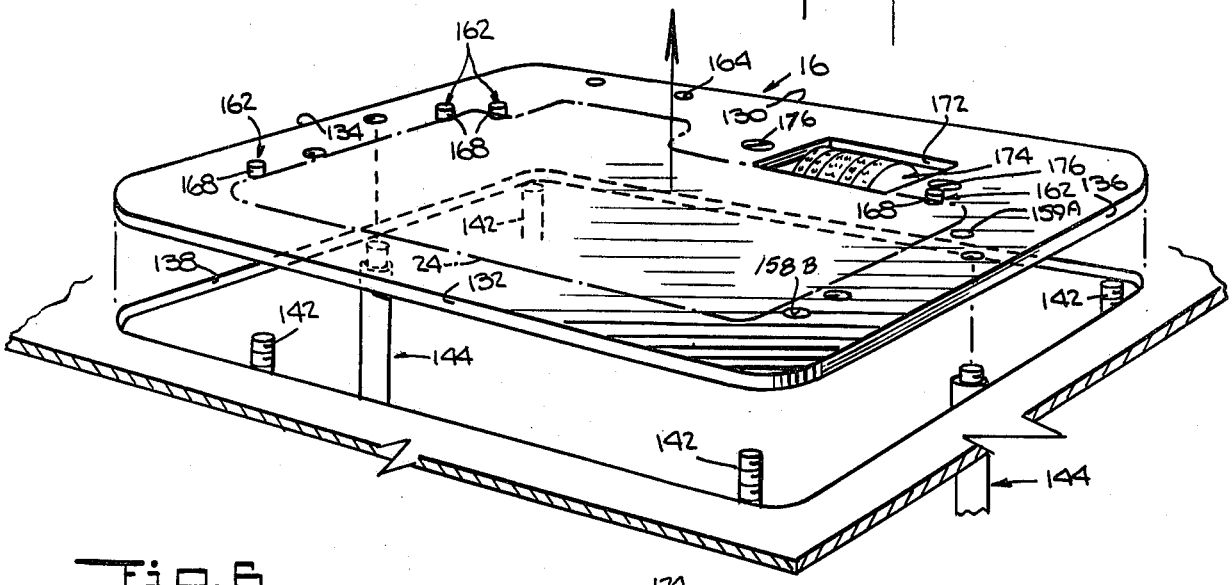
FIG. 5 is a fragmentary, exploded perspective view of FIG. 3, showing the anvil being dismounted from the housing.
Figure 6:
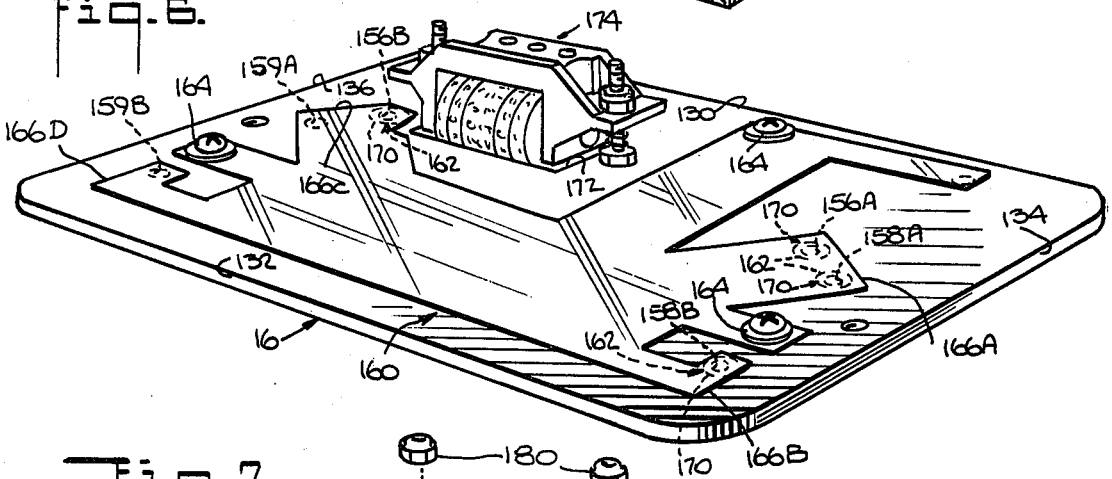
FIG. 6 is a bottom view of anvil of FIG. 5 laterally turned 180° clockwise.
Figure 7:
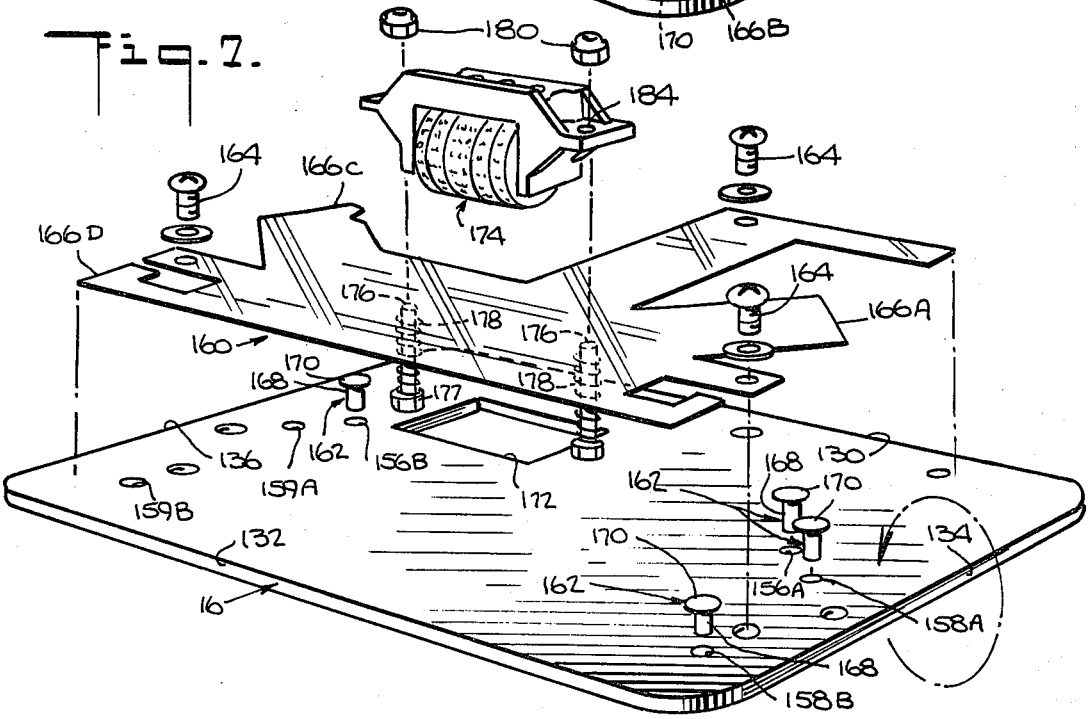
FIG. 7 is an exploded view of FIG. 6, showing the selectively adjustable printing device and leaf spring being detached from a given side of the platen to which it is attached in FIG. 6.

For changing the location of the printing device 174 (FIG. 4) with respect to the print-ready position of the roller platen 52, for example from the upper right hand quadrant of the the anvil 16 to its upper left and quadrant, the anvil 16 (FIG. 5), and attached printing device 174, spring 160 and pins 162 is turned over, for example, by laterally rotating the same 180° about an axis extending parallel to the anvil's side edges 134 and 136, from the orientation shown in FIG. 5 to the orientation shown in FIG. 6. Thereafter, the printing device 174, spring 160 and pins 162 are removed from the major surface of the anvil 16 to which they are attached (FIG. 7), and aligned with the opposite major surface of the anvil 16 as shown in FIG. 8. Whereupon the printing device 174, spring 16 andpins 162 may be attached to the oppositely oriented major surface of the anvil 16 as shown in FIG. 9. In this connection it is noted that in both FIGS. 5 and 9, pins 162 project through the left hand side of the anvil 16. As shown in FIG. 5, the anvil's pin openings 158A and 158B are provided with pins 162, and pin openings 159A and 159B are not provided with pins 162, when the printing device 174 is located in the upper right quadrant of the anvil 16. On the other hand, as shown in FIG. 9, the anvil's pin openings 159A and 159B are provided with pins 162, and pin openings 158A and 158B are not provided with pins 162, when the printing device 174 is located in the upper left hand quadrant of the anvil 16. Thus, fewer pins 162 than openings 158A, 158B, 159A and 159B are required for locating a given embossed card 24 on a given major surface of the platen 16 (FIGS. 5 and 9). To facilitate attachment of the printing device 174, springs 160 and pins to the either of the major surfaces of the anvil 16 (FIGS. 5 and 9), each of the openings formed in the anvil 16 extends through the anvil 16, and the opposed major surfaces of the anvil 16 are respectively flat and extend parallel to each other.

In accordance with the objects of the invention there has been disclosed improved imprinting apparatus including an anvil which is constructed and arranged for orienting either of its opposed major surfaces upwardly beneath a roller platen and for carrying a printing device in a first location relative to the print-ready position of the roller platen when one of said major surfaces is upwardly oriented and in another location relative to that position when the other of said major surfaces is upwardly oriented.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. Imprinting apparatus comprising:

a. framework;

b. a printing device;

c. a roller platen movably attached to the framework, said roller platen being movable from a print ready position to a home position, said roller platen disposed for urging a pressure sensitive medium into imprinting engagement with the printing device in the course of movement thereof; and d. means for supporting said printing device, said supporting means including an anvil, said anvil having opposed major surfaces, said supporting means including means removably attaching said anvil to said framework for carrying said printing device in either of two different locations relative to the print-ready position of said roller platen, and said carrying means attaching said anvil to said framework to permit facing either of said major surfaces toward said roller platen for carrying said printing device in one of said locations when one of said major surfaces is so faced and in the other of said locations when the other of said major surfaces is so faced.

2. The apparatus according to claim 1, wherein said supporting means includes means removably attaching said printing device to said anvil for disposition of said printing device in imprinting relationship with respect to said roller platen when either of said major surfaces is faced toward said roller platen.

3. The apparatus according to claim 1, wherein said anvil includes an aperture through which said printing device protrudes.

4. The apparatus according to claim 1, wherein the respective major surfaces of said anvil are formed for disposition thereon of an embossed data bearing card in imprinting relationship with respect to said roller platen.

5. The apparatus according to claim 1, wherein said anvil includes an aperture through which said printing device protrudes when either of said major surfaces is faced toward said roller platen.

6. The apparatus according to claim 1, including means for locating on said anvil a data embossed card relative to said printing device when either of said major surfaces are faced toward said roller platen.

7. The apparatus according to claim 6, wherein said locating means includes a leaf spring and a pin, said anvil including a plurality of openings for slidably receiving said pin, said pin being inserted in one of said openings for locating an embossed card when one of said major surfaces is faced toward said roller platen and being inserted in another of said openings for locating an embossed card when the other major surface is faced toward said roller platen, and said spring removably attachable to said platen for retaining the inserted pin.

8. Imprinting apparatus comprising:

a. framework;

b. a printing device;

c. a roller platen attached in the framework for movement over the printing device from a print-ready position to a home position, said roller platen disposed in imprinting relationship with respect to the printing device in the course of movement thereof over said printing device, d. means for carrying the printing device in either of two locations relative to the print-ready position of the roller platen, said carrying means including an anvil having opposed major surfaces, said anvil removably attachable to said framework for facing either of said major surfaces toward said roller platen, said anvil carrying said printing device in one of said locations when one of said major surfaces is faced toward said roller platen, and said anvil carrying said printing device in the other of said locations when the other of said major surfaces is faced toward said roller platen.

9. The imprinting apparatus according to claim 8, wherein said anvil includes an aperture through which the attached printing device protrudes for disposition in imprinting relationship with respect to said roller platen.

10. The imprinting apparatus according to claim 8, wherein the anvil's major surfaces are respectively dimensioned for disposition of an embossed data bearing card thereon in imprinting relationship with respect to said roller platen.

11. The imprinting apparatus according to claim 10, including means for locating an embossed data bearing card in a predetermined position with respect to said printing device when either of the major surfaces of the anvil are faced toward said roller platen.

12. In an imprinter including a printing device and a roller platen for urging a pressure sensitive medium into imprinting engagement with the printing device, apparatus for supporting the printing device in either of two locations, said apparatus comprising:

a. an anvil having opposed major surfaces, said anvil having means for carrying said printing device in one of said locations when one of said major surfaces is faced toward said roller platen and for carrying said printing device in the other of said locations when the other of said major surfaces is faced toward said roller platen; and b. means for facing either of said surfaces toward said roller platen.

* * * * *